United States Patent [19]

Eickemeyer et al.

[11] Patent Number: 4,466,883

[45] Date of Patent: Aug. 21, 1984

[54] NEEDLE COKE PROCESS AND PRODUCT

[75] Inventors: Daniel B. Eickemeyer, Crete; Maurice K. Rausch, Homewood; Gerald E. Tollefsen, Calumet City, all of Ill.

[73] Assignee: Atlantic Richfield Company, Philadelphia, Pa.

[21] Appl. No.: 508,378

[22] Filed: Jun. 27, 1983

[51] Int. Cl.[3] ..... C10B 55/00

[52] U.S. Cl. ..... 208/50; 208/87; 208/89; 208/131; 208/106

[58] Field of Search ..... 208/50, 131, 87, 106, 208/89

[56] References Cited

U.S. PATENT DOCUMENTS

| | | | |
|---|---|---|---|
| 3,112,181 | 11/1963 | Petersen et al. | 208/50 |
| 3,349,028 | 10/1967 | Burch | 208/87 |
| 4,049,538 | 9/1977 | Hayashi et al. | 208/50 |
| 4,108,798 | 8/1978 | Sze et al. | 208/50 |
| 4,116,815 | 9/1978 | Sunago et al. | 208/87 |
| 4,388,408 | 6/1983 | Sien et al. | 208/50 |

*Primary Examiner*—Delbert E. Gantz
*Assistant Examiner*—Anthony McFarlane
*Attorney, Agent, or Firm*—John B. Goodman

[57] ABSTRACT

A process for the production of an improved grade of needle coke employing as a feedstock selected proportions of a pyrolysis furnace oil together with a hydrodesulfurized blend of a clarified oil and a lubricating oil extract.

13 Claims, No Drawings

NEEDLE COKE PROCESS AND PRODUCT

BACKGROUND OF THE INVENTION

This invention relates to an improved process for the production of needle coke and to the highly crystalline coke product thereby produced. The highly crystalline needle coke product of this invention possesses remarkably superior properties, especially suitable for the production of graphite electrodes.

The grades of coke generally obtainable by thermal processing of coal or heavy petroleum stocks are not suitable for manufacture of graphite electrodes because of their noncrystalline nature and their contamination with metals. There has developed technology for the production from petroleum stocks of needle coke having a suitably crystalline character and capable of thermal conversion into a highly graphitic coke. Such highly crystalline graphitic cokes command a premium market for use in high-power electrodes.

Processes for the production of suitable needle coke require that pitch and similar precursors of noncrystalline coke be removed from the petroleum stock which may, desirably, include residues from catalytic cracking, thermal cracking, and crude distillation processes. Unstable components that tend to form pitch are removed by a combination of heat-treating and distillation steps. The remaining heavy petroleum oil may then be coked thermally, as by delayed coking, to yield an improved crystalline coke, or needle coke. Another route to an improved high-crystalline coke requires careful segregation of petroleum residual stocks lacking in those precursors which lead to amorphous or metals-contaminated coke.

The use of sulfur, in elemental or mercaptan form, to eliminate sludging and caking during the removal of pitch-forming components from a petroleum oil, is described in U.S. Pat. No. 3,687,840. The use of added sulfur as a means for developing a pitch-free coking feedstock has been carried further in U.S. Pat. No. 4,108,798.

Cokes suitable for the production of highly graphitic electrodes are generally characterized as having a low coefficient of thermal expansion, no greater than about $1.0\times10^{-6}/°C.$ when measured in the direction of extrusion (with the grain) over the range from 100° to 400° C. Similarly, suitable cokes possess a maximum transverse magnetoresistance of at least about 16.0%.

SUMMARY OF THE INVENTION

This invention relates to an improved method for the production of needle coke, having superior quality and particularly useful in the manufacture of highly crystalline graphitic artifacts. This invention additionally relates to the particular high-crystalline petroleum coke when prepared by the process disclosed herein.

The process of this invention employs a novel, improved petroleum feedstock comprising pyrolysis furnace oil and selected proportions of a hydrodesulfurized blend of a clarified oil and a lubricating oil extract fraction.

When employed in a preferred sequence of process steps, the feedstock of this invention affords a needle coke having a superior physical properties, including a very low coefficient of thermal expansion and a high magnetoresistance.

The hydrodesulfurized blend of oils comprises from about 30 to about 70 volume percent clarified oil and from about 30 to about 70 volume percent lubricating oil extract. The feedstock of this invention comprises from about 40 to about 70 weight percent of the hydrodesulfurized blend of oils together with from about 30 to about 60 weight percent of a pyrolysis furnace oil, preferably from the production of ethylene by thermal cracking of a selected gas oil fraction.

The hydrodesulfurization step, which effects a substantial desulfurization, may employ any active hydrodesulfurization catalyst but preferably employs a catalytic mixture of cobalt and molybdenum oxides, distributed upon an active alumina support material.

DESCRIPTION OF THE INVENTION

The process of this invention is related to the selection and preparation of feedstock components to be employed in a coking operation. The invention is particularly related to the employment of a combination of particular petroleum process fractions found to enhance the crystalline nature of the needle coke product. Such process fractions similarly are less susceptible to the formation of pitch or pitch-related residual components which lead to the formation of a more amorphous coke product.

The process of this invention is also related to a particular pre-treatment of the selected petroleum feedstock components. It has been found that hydrodesulfurization of certain components both reduces the sulfur content of the feedstock and improves the potential for conversion to highly crystalline needle coke.

The product of this invention comprises the highly crystalline, or needle, coke prepared by the process of this invention for subsequent calcination and graphitization at selected high temperatures and use, for example, in the manufacture of high-quality graphite electrodes.

Suitable feedstock components include pyrolysis furnace oils, clarified oils and lubricating oil extracts. A preferred pyrolysis furnace oil comprises the furnace oil fraction recovered from the thermal cracking of oils to provide a source of light olefins, particularly ethylene. Such fractions from thermal cracking tend to be rich in coke-forming components. Clarified, or decanted, oils can also comprise the fractionator bottoms from the catalytic cracking of a broad range of gas oil feedstocks to produce gasoline blending components. As the designation indicates, clarified oils have been freed of any catalyst fines that may have accumulated in the product fractionator. Lubricating oils typically are derived from heavy overhead fractions of selected crude oil stocks. Lubricating oil base stocks are refined further by separation of the more aromatic components, as by solvent extraction. The extract oil, particularly when recovered from a phenol extraction operation, comprises a preferred solvent refined lubricating oil extract component of the feedstock of this invention.

Accordingly, the clarified oil components of the feedstock of this invention includes cracking residues, from both thermal and catalytic refining operations. It has been found that particularly desirable coke properties may be achieved when the process of this invention employs a blend of clarified oil and lubricating oil extract, the blend comprising from about 30 to about 70 volume percent of clarified oil together with from about 70 to about 30 volume percent of lubricating oil extract. Preferably, the blend comprises from about 50 to about 65 volume percent clarified oil together with from about 50 to about 35 volume percent lubricating oil extract.

It has also been found that especially desirable coke properties may be realized when the process of this invention includes a hydrodesulfurization step applied to the described blend of clarified oil and lubricating oil extract.

The component blend is subjected to a hydrodesulfurization operation in the presence of hydrogen with a solid hydrogenation catalyst, preferably at a temperature of about 550° to about 750° F., more preferably within the range from about 600° to about 725° F. Other reaction conditions preferably include pressures ranging from about 500 to about 2500 psig, more preferably from about 500 to about 1,500 psig; liquid hourly space velocities (LHSV) of about 0.2 to about 20, more preferably from about 0.5 to about 15, and molecular hydrogen to feed ratios of about 500 to about 3500 scf/b, more preferably from about 1500 to about 2500 scf/b. Particularly preferred reaction conditions include a temperature within the range from about 650° to about 725° F., a pressure within the range from about 500 to about 750 psig, a liquid hourly space velocity within the range from about 1 to about 10 vol/vol/hr, and a hydrogen feed rate within the range from about 2000 to about 2500 scf/b.

The solid catalyst employed in the hydrodesulfurization operation is preferably a sulfur-resistant, non-precious metal hydrogenation catalyst, such as those conventionally employed in the hydrogenation of heavy petroleum oils. Examples of suitable catalytic ingredients are Group VIb metals, such as molybdenum, tungsten and/or chromium, and Group VIII metals of the iron groups, such as cobalt and/or nickel. These metals are present in minor, catalytically effective amounts, for instance, from about 1 to about 30 weight percent of the catalyst, and may be present in the elemental form or in combined form such as the oxides or sulfides, the sulfide form being preferred. Mixtures of these metals or compounds of two or more of the oxides or sulfides can be employed. Examples of such mixtures or compounds are mixtures of nickel and/or cobalt oxides with molybdenum oxide. These catalytic ingredients are generally employed while disposed upon a suitable carrier of the solid oxide refractory types, e.g., a predominately calcined or activated alumina. To avoid undue cracking, the catalyst base and other components have little, if any, hydrocarbon cracking activity. Commonly employed catalysts often have about 1 to about 10, preferably about 2 to about 10, weight percent of an iron group metal and about 5 to about 30 weight percent, preferably about 10 to 25 weight percent, of a Group VIb metal (calculated as oxide). Advantageously, the catalyst comprises nickel or cobalt, together with molybdenum, supported on alumina. Such preferred catalysts can be prepared by the method described in U.S. Pat. No. 2,938,002.

The highly desirable petroleum feedstock for the process of this invention comprises from about 30 to about 60 weight percent of a pyrolysis furnace oil admixed with from about 70 to about 40 weight percent of a hydrodesulfurized blend of clarified oil and lubricating oil extract as previously described. Preferably, the petroleum feedstock comprises from about 40 to about 50 weight percent of a pyrolysis furnace oil together with from about 60 to about 50 weight percent of the aforementioned hydrodesulfurized blend.

The coking process employed with the feedstock of this invention comprises, in order, a heat-soaking step, thermal cracking, flashing to separate a pitch-type residue, fractionation of the flashed oil to afford a cokable bottoms fraction. Finally, the cokable bottoms fraction is heated to coking temperature and subjected to delayed coking to yield the desired and improved needle coke.

Prior to the heat-soaking step, a minor quantity of sulfur may be added to the selected feedstock to improve the flow properties of the hot oil and to minimize the tendency of any pitch or pitch-like precursors to solidify or plug process apparatus or transfer lines. The added sulfur may be elemental sulfur or organic sulfur, preferably in the form of a mercaptan, thioether, disulfide, or as carbon disulfide. Sulfur is effective in small amounts, as from about 20 to about 200 ppm, and may readily be added as a dilute solution, e.g., about 1 weight percent in an aromatic solvent, such as toluene or mixed xylenes.

The heat-soaking step is effected by maintaining the feedstock, optionally sulfurized, at a temperature of at least about 450° F. for at least 5 minutes. This is conveniently accomplished in a closed vessel at ambient pressure. Generally, the temperature need not exceed about 600° F. nor the soaking time about 60 minutes.

The heat-soaked oil is next subjected to thermal cracking, as by passage through a tube heater. The cracking tubes are maintained at a temperature within the range from about 850° to about 1000° F. The oil is pumped through the cracking zone at a rate selected to provide a cracking time of from about 60 to about 150 seconds. The cracking pressure will depend upon the extent of cracking which occurs, but usually is within the range from about 200 to about 600 psig.

The hot, cracked oil is passed to a flashing zone where cracked product and most of the uncracked feedstock are taken overhead, leaving a heavy residue comprising pitch and heavy components having a substantial tendency to yield pitch when subjected to high-temperature conditions. The pitch-free flash drum overhead stream is then fractionated to recover cracked gases, light cracked oils and a bottoms fraction suitable for delayed coking to provide needle coke thereby.

The fractionator bottoms stream is heated to coking temperature and fed to a delayed coking zone where the bottoms oil is maintained at coking temperature for from about 12 to about 48 hours. Suitable coking temperatures are generally within the range from about 800° to about 900° F. After removal of liquid products from the coking operation, there is recovered a solid fraction comprising the needle coke product of this invention.

The needle coke obtained in the process set forth above is calcined by maintenance at a temperature within the range from about 1300° to about 1500° C., preferably about 1400° C., for from about 2 to about 6 hours, preferably from about 3 to about 4 hours. The calcined coke product possesses very small amounts of ash components and also has an extremely low sulfur content. Ash content for the product of this invention is consistently less than 0.05 weight percent. Similarly, the sulfur content is below 1.0 weight percent.

Finally, graphitization of the calcined needle coke is effected by heating at a temperature within the range from about 2500° to about 3200° C. for from about 30 to about 120 minutes.

When graphitized artifacts are prepared from the coke product of this invention, consistently low values are observed for the coefficient of thermal expansion, and high values for magnetoresistance. Typically, a suitably ground sample of calcined coke is kneaded with a binder oil, fashioned into a rod, and baked at an elevated temperature, for example, about 1000° C., for a time period ranging from about 2 to about 4 hours. The baked rod is then graphitized under conditions as set forth above. The coefficient of thermal expansion, measured at 25 to 125° C., parallel to the grain, is consistently less than $0.2\times10^{-6}$/°C. Magnetoresistance is consistently greater than 20%.

The following examples is illustrative, without limitation of the process and product of this invention.

EXAMPLE

Part 1

A blend of clarified oil (60 volume percent) and lubricating oil extract (40 volume percent) was prepared. Physical properties of the respective oils and the oil blend are presented in Table I.

TABLE I

| Sample | A | B | C |
|---|---|---|---|
| Composition | Clarified Oil | Lubricating Oil Extract | 60 Vol. % A 40 Vol. % B |
| Gravity, °API | 2.4 | 13.6 | 5.5 |
| Carbon Residue, wt. % | 9.2 | 0.2 | 5.2 |
| Sulfur, wt. % | 2.2 | 1.2 | 2.0 |
| ASTM Distillation, °F. | | | |
| IBP | 392 | 698 | 479 |
| 5% | 554 | 752 | 686 |
| 50% | 757 | 784 | 828 |
| 95% | 923 | 851 | 979 |

Part 2

Two samples of oil blend C, consisting of 60 volume percent clarified oil and 40 volume percent lubricating oil extract, were each processed in a Run under typical hydrodesulfurization conditions in the presence of a conventional desulfurization catalyst. The catalyst comprised 3.3 weight percent cobalt oxide and 14.0 weight percent molybdenum oxide, dispersed on an active alumina base. Process conditions for each Run are set forth in Table II.

TABLE II

| Run No. | 1 | 2 |
|---|---|---|
| Temperature, °F. | 697 | 698 |
| Pressure, psig | 600 | 620 |
| Space Velocity, V/V/hr. | 5.78 | 2.22 |
| Hydrogen Rate, scf/b | 2200 | 2200 |

Part 3

The hydrodesulfurized product oils from Run 1 and Run 2 were separately blended with a pyrolysis furnace oil to provide blends containing 57 weight percent of hydrodesulfurized oil and 43 weight percent of pyrolysis furnace oil. Physical properties of the respective blend components are presented in Table III.

TABLE III

| Sample | D | E | F |
|---|---|---|---|
| Composition | Run No. 1 Product | Run No. 2 Product | Pyrolysis Furnace Oil |
| Gravity, °API | 8.5 | 9.3 | −1.2 |
| Carbon Residue, wt. % | 3.0 | 2.1 | 16.1 |

TABLE III-continued

| Sample | D | E | F |
|---|---|---|---|
| Sulfur, wt. % | 0.90 | 0.40 | 0.49 |
| ASTM Distillation, °F. | | | |
| IBP | 487 | 442 | 437 |
| 5% | 669 | 614 | 473 |
| 50% | 812 | 807 | 671 |
| 90% | 968 | 963 | 797 |

Physical properties of the respective oil blends, together with a blend of the respective untreated components, are presented in Table IV.

TABLE IV

| Sample | G | H | I |
|---|---|---|---|
| Composition | 43 Wt. % F 57 Wt. % D | 43 Wt. % F 57 Wt. % E | 43 Wt. % F 36 Wt. % A 21 Wt. % B |
| Gravity, °API | 3.3 | 3.9 | 2.6 |
| Carbon Residue, wt. % | 9.6 | 8.1 | 11.2 |
| Sulfur, wt. % | 0.82 | 0.56 | 1.33 |
| ASTM Distillation, °F. | | | |
| IBP | 428 | 428 | 401 |
| 5% | 500 | 505 | 500 |
| 50% | 752 | 743 | 783 |
| 90% | 828 | 860 | 905 |

Part 4

Oil blends G, H and I were separately treated under the following conditions.

Butyl mercaptan, as a 1 weight percent solution in mixed xylenes, is stirred into the oil blend to provide added sulfur in the amount of 100 ppm. The sulfur-containing oil blend is then heated in a closed vessel to 555° F. and maintained at that temperature for 35 minutes under ambient pressure. The heat-soaked oil is then pumped through a tube heater, under a pressure of 365 psig, the exit temperature of the tube heater being maintained at 950° F. The oil residence time is maintained within the range from 90 to 100 seconds at the thermal cracking temperature. The hot effluent oil is then flashed to recover an overhead cracked oil as the major product, together with a heavy bottom pitch. The overhead oil product is condensed by cooling and fractionated to remove overhead the components boiling in the gasoline and light gas oil range.

The fractionator bottoms oil is recovered and thereafter coked by holding under pressure at approximately 825° F. for 24 hours. The resulting needle coke is recovered and calcined at 1400° C. for 3 hours. The calcined coke is ground and the 30–60 mesh fraction is blended with a binder pitch. The blend is kneaded, extruded into a rod, baked at 1000° C. for 3 hours and finally graphitized by heating at 3000° C. for 1 hour.

Compositions and properties of the respective cokes are presented in Table V.

TABLE V

| Sample | G | H | I |
|---|---|---|---|
| Calcined Coke | | | |
| Ash, wt. % | 0.04 | 0.01 | 0.06 |
| Sulfur, wt. % | 0.91 | 0.62 | 1.37 |
| Graphite Artifact | | | |
| Coefficient of Thermal Expansion, $10^{-6}\times1$° C., 25–125° C. | | | |
| With grain | Less than | Less than | Greater |

TABLE V-continued

| Sample | G | H | I |
|---|---|---|---|
| | 0.2 | 0.2 | than 0.3 |
| Magnetoresistance, % | Greater Than 20% | Greater Than 20% | Greater Than 20% |

We claim:

1. In a process for the production of highly crystalline petroleum coke from a petroleum feedstock, wherein the petroleum feedstock is successively subjected to heat soaking in the presence of from about 20 to about 200 parts per million of added dissolved sulfur, thermal cracking, flashing to separate pitch as a residue from the pitch-free overhead stream, separating a heavy cokable residue from the pitch-free overhead stream, and subjecting the heavy cokable residue to delayed coking, the improvement wherein there is utilized as petroleum feedstock a blend comprising from about 30 to about 60 weight percent of a pyrolysis furnace oil and from about 40 to about 70 weight percent of a hydrotreated mixture comprising from about 30 to 70 volume percent of clarified catalytically cracked oil and from about 30 to 70 volume percent solvent refined lubricating oil extract.

2. The process of claim 1 wherein the petroleum feedstock is subjected to heat soaking at a temperature of at least about 450° F. for at least about 5 minutes in the presence of from about 20 to about 200 parts per million of added dissolved sulfur, and thereafter to thermal cracking at temperatures ranging up to about 1,000° F.

3. The process of claim 1 wherein the hydrotreated mixture comprises from about 50 to about 65 volume percent clarified catalytically cracked oil and from about 35 to about 50 volume percent solvent refined lubricating oil extract.

4. The process of claim 1 wherein the petroleum feedstock blend comprises from about 40 to about 50 weight percent of a pyrolysis furnace oil and from about 50 to about 60 weight percent of a hydrotreated mixture of clarified catalytically cracked oil and solvent refined lubricating oil extract.

5. The process of claim 1 wherein the pyrolysis furnace oil is derived from an ethylene production process.

6. The process of claim 1 wherein the mixture of clarified catalytically cracked oil and solvent refined lubricating oil extract is hydrotreated by passage over a hydrotreating catalyst at a process temperature within the range from about 550° to about 750° F., a reaction pressure within the range from about 500 to about 2500 psig, a liquid hourly space velocity within the range from about 0.2 to about 20, and a hydrogen-to-feed ratio within the range from about 500 to about 3500 scf/b.

7. The process of claim 6 wherein the process temperature is within the range from about 600° to about 725° F.

8. The process of claim 6 wherein the reaction pressure is within the range from about 500 to about 1500 psig.

9. The process of claim 6 wherein the liquid hourly space velocity is within the range from about 0.5 to about 15.

10. The process of claim 6 wherein the hydrogen-to-feed ratio is within the range from about 1500 to about 2500 scf/b.

11. The process of claim 6 wherein the hydrotreating catalyst comprises from about 1 to about 10 weight percent of an iron group metal, and from about 5 to about 30 weight percent of a Group VI-B metal, disposed upon an activated alumina.

12. The process of claim 11 wherein the iron group metal is selected from the class consisting of cobalt, nickel and mixtures thereof.

13. The process of claim 11 wherein the Group VI-B metal is selected from the class consisting of molybdenum, tungsten, chromium and mixtures thereof.

* * * * *